US010451365B2

(12) United States Patent
Khatami

(10) Patent No.: US 10,451,365 B2
(45) Date of Patent: Oct. 22, 2019

(54) TUBE SHEETS AND TUBE SHEET ASSEMBLIES

(71) Applicant: Rheem Manufacturing Company, Atlanta, GA (US)

(72) Inventor: Reza Khatami, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 15/612,443

(22) Filed: Jun. 2, 2017

(65) Prior Publication Data

US 2018/0347917 A1 Dec. 6, 2018

(51) Int. Cl.

| | |
|---|---|
| ***F28F 9/02*** | (2006.01) |
| ***F24H 1/28*** | (2006.01) |
| ***F28D 7/16*** | (2006.01) |
| ***F28D 21/00*** | (2006.01) |
| *F28F 9/013* | (2006.01) |

(52) U.S. Cl.

CPC ..... *F28F 9/0229* (2013.01); *F24H 1/287* (2013.01); *F28D 7/16* (2013.01); *F28D 21/0007* (2013.01); *F28F 9/0224* (2013.01); *F28F 9/0131* (2013.01); *F28F 9/0217* (2013.01); *F28F 9/0219* (2013.01)

(58) Field of Classification Search

CPC ..... F28F 9/0217; F28F 9/0219; F28F 9/0229; F28F 9/0224; F28F 9/0131

USPC ..... 165/162

See application file for complete search history.

(56) References Cited

U.S. PATENT DOCUMENTS

| | | | | |
|---|---|---|---|---|
| 5,181,561 | A * | 1/1993 | Ayers | F28F 9/0131 122/510 |
| 5,915,472 | A * | 6/1999 | Takikawa | F28D 7/1607 165/158 |
| 6,142,215 | A | 11/2000 | Paulsen et al. | |
| 2010/0116478 | A1 * | 5/2010 | Wanni | F28D 7/16 165/162 |

FOREIGN PATENT DOCUMENTS

| | | |
|---|---|---|
| CN | 202329369 | 7/2012 |
| JP | 2014169840 | 9/2014 |
| RU | 2153643 | 7/2000 |

OTHER PUBLICATIONS

International Search Report for PCT/US2018/028374, dated Aug. 2, 2018.

* cited by examiner

*Primary Examiner* — Joel M Attey

(74) *Attorney, Agent, or Firm* — King & Spalding LLP

(57) ABSTRACT

A tube sheet for a thermal transfer device can include a body having a plurality of apertures that traverse therethrough, where the plurality of apertures are configured to receive a plurality of tubes of the thermal transfer device. The tube sheet can also include an outer perimeter defining the body, where the outer perimeter has at least one first recess feature disposed therein. The at least one first recess feature can have a first shape and a first size, where the first shape is any shape aside from a semi-circle.

9 Claims, 9 Drawing Sheets

TUBE SHEETS AND TUBE SHEET ASSEMBLIES

TECHNICAL FIELD

Embodiments described herein relate generally to heat exchangers, and more particularly to tube sheets and tube sheet assemblies for heat exchangers.

BACKGROUND

Heat exchangers, boilers, condensing boilers, combustion chambers, water heaters, and other similar devices (generally referred to herein as heat exchangers) control or alter thermal properties of one or more fluids. Heat exchangers have a number of components. One such component is a tube sheet (also sometimes called a tubesheet). A tube sheet is a plate that secures both ends of one or more tubes (e.g., heat exchanger tubes, condenser tubes) in place. The tube sheet helps make the flow of fluids more uniform in the heat exchanger system.

SUMMARY

In general, in one aspect, the disclosure relates to a tube sheet for a thermal transfer device. The tube sheet can include a body having multiple apertures that traverse therethrough, where the apertures are configured to receive multiple tubes of the thermal transfer device. The tube sheet can also include an outer perimeter defining the body, where the outer perimeter has at least one first recess feature disposed therein. The at least one first recess feature can have a first shape and a first size, where the first shape is any shape aside from a semi-circle.

In another aspect, the disclosure can generally relate to a tube sheet for a thermal transfer device. The tube sheet can include a body having multiple apertures that traverse therethrough, where the apertures is configured to receive multiple tubes of the thermal transfer device. The tube sheet can also include an outer perimeter defining the body, where the outer perimeter has at least one first recess feature disposed therein. The at least one first recess feature can have a first shape and a first size, where the first shape is a semi-circle, and where the at least one recess feature fails to be disposed continuously and equally over an entirety of the outer perimeter.

In another aspect, the disclosure can generally relate to a tube sheet assembly for a thermal transfer device. The tube sheet assembly can include a first tube sheet and a second tube sheet. The first tube sheet can include a first body having multiple first apertures that traverse therethrough, where the first apertures are configured to receive a first end of multiple tubes of the thermal transfer device. The first tube sheet can also include a first outer perimeter defining the first body, where the first outer perimeter has at least one first recess feature disposed therein, where the at least one first recess feature has a first shape and a first size, where the first shape is any shape aside from a semi-circle. The second tube sheet can include a second body having multiple second apertures that traverse therethrough, where the second apertures are configured to receive a second end of the plurality of tubes of the thermal transfer device. The second tube sheet can also include a second outer perimeter defining the second body.

These and other aspects, objects, features, and embodiments will be apparent from the following description and the appended claims.

BRIEF DESCRIPTION OF THE DRAWINGS

The drawings illustrate only example embodiments of tube sheets and tube sheet assemblies, and are therefore not to be considered limiting of its scope, as tube sheets and tube sheet assemblies may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1B:
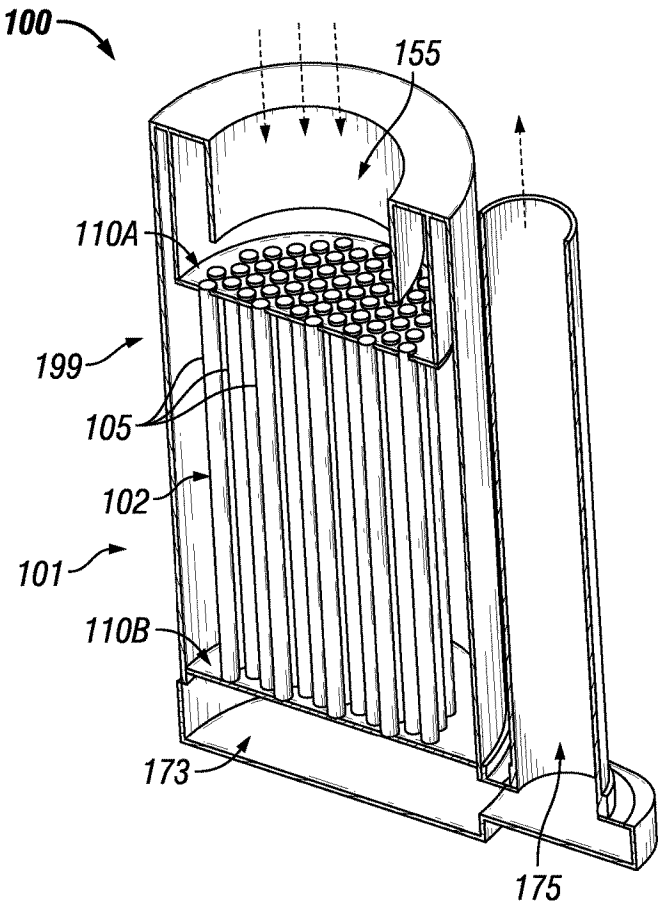
FIG. 1B (Prior Art)
FIGS. 1A and 1B show a boiler in which the example embodiments of tube sheets and tube sheet assemblies as described herein can be implemented.

The example embodiments discussed herein are directed to systems, methods, and devices for tube sheets and tube sheet assemblies. Example embodiments can be directed to any of a number of thermal transfer devices, including but not limited to boilers, condensing boilers, heat exchangers, and water heaters. Further, one or more of any number of fluids can flow through example tubes (also called heat exchanger tubes or HX tubes herein) and/or tube assemblies. Examples of such fluids can include, but are not limited to, water, deionized water, steam, glycol, and dielectric fluids.

Example embodiments can be pre-fabricated or specifically generated (e.g., by shaping a malleable body) for a particular boiler or other vessel. Example embodiments can have standard or customized features (e.g., shape, size, features on the inner surface, pattern, configuration). Therefore, example embodiments described herein should not be considered limited to creation or assembly at any particular location and/or by any particular person.

The tube sheets and tube sheet assemblies (or components thereof) described herein can be made of one or more of a number of suitable materials and/or can be configured in any of a number of ways to allow the heat exchangers in which the tube sheets and tube sheet assemblies are disposed to meet certain standards and/or regulations while also maintaining reliability of the heat exchanger, regardless of the one or more conditions under which the tube sheets and tube sheet assemblies can be exposed. Examples of such materials can include, but are not limited to, aluminum, stainless steel, ceramic, fiberglass, glass, plastic, and rubber.

As discussed above, tube sheets and tube sheet assemblies (or heat exchangers in which tube sheets and tube sheet assemblies are disposed) can be subject to complying with one or more of a number of standards, codes, regulations, and/or other requirements established and maintained by one or more entities. Examples of such entities can include, but are not limited to, the American Society of Mechanical Engineers (ASME), American Society of Heating, Refrigeration and Air Conditioning Engineers (ASHRAE), the Tubular Exchanger Manufacturers Association (TEMA), Underwriters' Laboratories (UL), American National Standard Institute (ANSI), the National Electric Code (NEC), and the Institute of Electrical and Electronics Engineers (IEEE). An example tube sheet and/or tube sheet assembly allows a heat exchanger to continue complying with such standards, codes, regulations, and/or other requirements. In other words, an example tube sheet or tube sheet assembly, when disposed within a heat exchanger, does not compromise compliance of the heat exchanger with any applicable codes and/or standards.

Any example tube sheets and tube sheet assemblies, or portions thereof, described herein can be made from a single piece (e.g., as from a mold, injection mold, die cast, 3-D printing process, extrusion process, stamping process, or other prototype methods). In addition, or in the alternative, an example tube sheet or tube sheet assembly (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with a heat exchanger or components thereof. Examples of a user may include, but are not limited to, an engineer, a maintenance technician, a mechanic, an employee, an operator, a consultant, a contractor, and a manufacturer's representative. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of a tube sheet or tube sheet assembly to become coupled, directly or indirectly, to a portion of a heat exchanger and/or to another portion of a tube sheet or tube sheet assembly. A coupling feature can include, but is not limited to, a snap, a clamp, a portion of a hinge, an aperture, a recessed area, a protrusion, a slot, a spring clip, a tab, a detent, and mating threads. One portion of an example tube sheet or tube sheet assembly can be coupled to a heat exchanger (or portion thereof) by the direct use of one or more coupling features.

In addition, or in the alternative, a portion of an example tube sheet or tube sheet assembly can be coupled to a heat exchanger (or portion thereof) using one or more independent devices that interact with one or more coupling features disposed on a component of the tube sheet or tube sheet assembly. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. Similarly, an element of a component that is described with respect to a figure may not expressly be numbered in the figure. In such a case, the numbering scheme used in the same or a different figure for the same or similar component can be inferred to the un-numbered component in the figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the components in the figures herein parallel the numbering scheme for the corresponding components described in another figure in that each corresponding component is a three or four digit number having the identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of tube sheets and tube sheet assemblies will be described more fully hereinafter with reference to the accompanying drawings, in which example embodiments of tube sheets and tube sheet assemblies are shown. Tube sheets and tube sheet assemblies may, however, be embodied in many different forms and should not be construed as limited to the example embodiments set forth herein. Rather, these example embodiments are provided so that this disclosure will be thorough and complete, and will fully convey the scope of tube sheets and tube sheet assemblies to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation, and are not meant to limit embodiments of tube sheets and tube sheet assemblies. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1A:
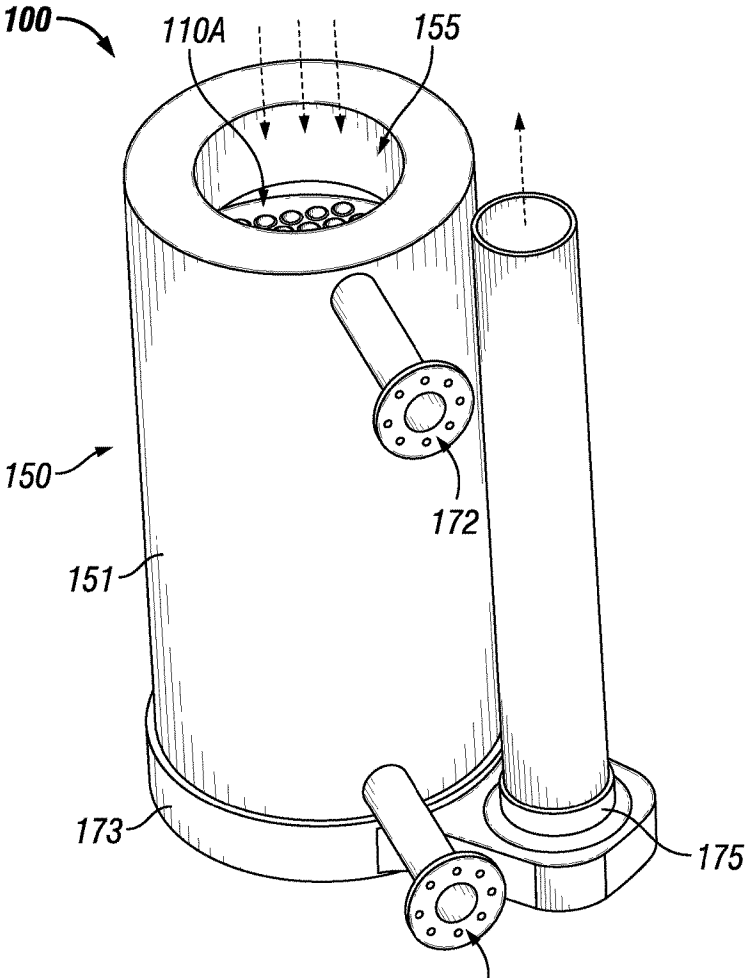
FIG. 1A (Prior Art)

FIGS. 1A and 1B show a prior art heat exchanger 100 in which the example tube sheets and tube sheet assemblies described herein can be implemented. Specifically, FIG. 1A shows a perspective view of the heat exchanger 100, and FIG. 1B shows a cross-sectional perspective view of the heat exchanger 100. Referring to FIGS. 1A and 1B, the heat exchanger 100 includes one or more of any number of components. For example, in this case, the heat exchanger 100 includes at least one wall 151 that forms a cavity 155 (also called a combustion chamber herein). Toward the bottom of the boiler is a flue gas collection chamber 173 that provides a bridge between the cavity 155 of the heat exchanger 100 and an exhaust vent 175. Disposed within the cavity 155 in this case are two diffuser plates 110 (top diffuser plate 110A and bottom diffuser plate 110B) and a number of HX tubes 105 disposed between the diffuser plates 110. The two diffuser plates 110 can be called a diffuser assembly 199. The group of tubes 102 can be called a tube assembly 102. The combination of the diffuser assembly 199 and the tube assembly 102 can be called an assembly 101.

The heat exchanger 100 uses a mixture of a fuel (e.g., natural gas, propane, coal) and air to transfer heat to a fluid (e.g., water), and the heated fluid (e.g., water, steam) can be used for some other process or purpose. In some cases, the fuel can be premixed with some other component, such as air. For example, the fuel/air mixture can be introduced into the top of the heat exchanger 100, as shown at the top of FIGS. 1A and 1B. Once inside the top part of the cavity 155, there can be some heat source (e.g., a burner, and ignitor) that raises the temperature of the fuel/air mixture, resulting in combustion and burning of the fuel/air mixture. From there, the resulting hot gases (byproducts of the combustion of the fuel/air mixture) can be directed into the various HX tubes 105 and travel down those HX tubes 105 to the collection chamber 173. The hot gases then continue on to the exhaust vent 175 and leave the heat exchanger 100. The water vapor in the combustion products can either be in the vapor phase (non-condensing mode) or in the liquid phase (condensing mode), depending on the design of the heat exchanger 100.

At the same time another fluid (e.g., water) is brought into the bottom part of the heat exchanger 100 through the inlet 171. Once inside the cavity 155, the fluid comes into contact with the outer surfaces of the HX tubes 105. In many cases, the HX tubes 105 are made of a thermally conductive material. In this way, when the hot gases (from the combustion process) travels down the HX tubes 105, some of the heat from the fuel is transferred to the walls of the HX tubes 105. Further, as the fluid comes into contact with the outer surface of the walls of the HX tubes 105, some of the heat captured by the walls of the tubes HX 105 from the heated fuel is transferred to the fluid in the cavity 155. The heated fluid is drawn up toward the top of the cavity 155 of the heat exchanger 100, and is then drawn out of the heat exchanger 100 through the outlet 172. The heated fluid can then be used for one or more other processes, such as space heating and hot water for use in a shower, a clothes washing machine, and/or a dishwashing machine.

The HX tubes 105 are held in place within the cavity 155 of the boiler by tube sheets and the diffuser plates 110. The diffuser plates 110 can be coupled to an interior surface (e.g., disposed in a recess of an inner surface of the wall 151) of the heat exchanger 100. Although the major role of the diffuser plates 110 is to redirect the flow and to make the flow uniform inside the cavity 155 and around the HX tubes 105, from a structural point of view, the diffuser plates 110 can also be used, in conjunction with tube sheets, to maintain the position of the HX tubes 105 within the cavity 155.

Figure 2:
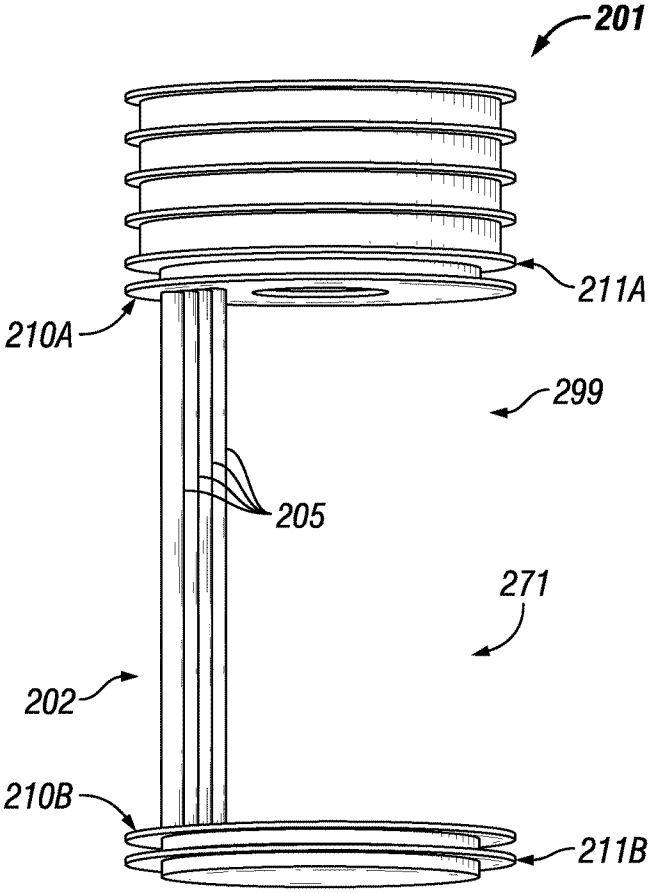
FIG. 2 (Prior Art)
FIG. 2 shows a subassembly for a heat exchanger as currently used in the art.

FIG. 2 shows a subassembly 201 for a heat exchanger currently used in the art. Referring to FIGS. 1A-2, the subassembly 201 includes two diffuser plates 210, with a top diffuser plate 210A being disposed near the top end of the HX tubes 205 close to a top tube sheet 211A, and with the bottom diffuser plate 210B being disposed near the bottom end of the HX tubes 205 close to a bottom tube sheet 211B. The HX tubes 205 collectively form a tube assembly 202. In addition to the diffuser assembly 299, there is a tube sheet assembly 271, which includes tube sheet 211A and tube sheet 211B. A tube sheet assembly 271 can include any number (e.g., two, four) of tube sheets in a heat exchanger.

Figure 3:
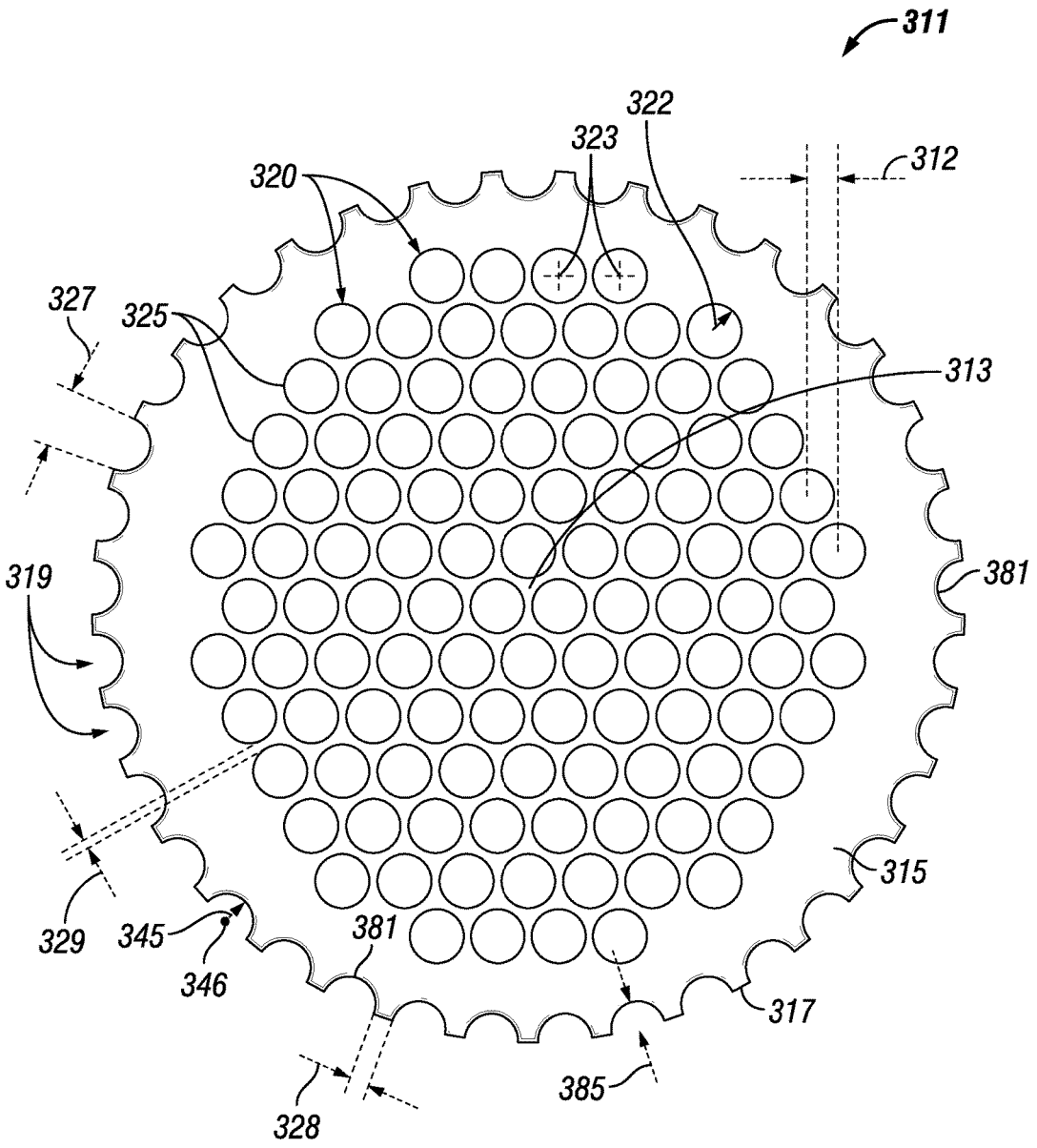
FIG. 3 shows a tube sheet currently used in the art.

FIG. 3 shows a top view of a tube sheet 311 currently used in the art. Referring to FIGS. 1A-3, tube sheet 311 of FIG. 3 has a body 315 through which a number of apertures 320 traverse. The body 315 has an outer perimeter 317 that forms, in this case when viewed from above, a circular shape having a diameter.

The tube sheet 311 can have multiple apertures 320 symmetrically laid out and centered around the center 313 of the body 315 of the tube sheet 311. The apertures 320 in this case are organized in linear columns where an adjacent column is offset by approximately ½ the height (in this case, also the diameter or two times the radius 322) of the aperture 320, so that the apertures 320 of adjacent columns almost touch each other and are separated by a distance 312. Each aperture 320 has an outer perimeter 325 (which is part of the body 315) that forms, when viewed from above, a circle having a radius 322 and a center 323.

The apertures 320 that traverse the body 315 of the tube sheet 311 receive an end of a HX tube (e.g., HX tube 205). The tube sheet 311 is the same, regardless of whether there are one or multiple tube sheets in a heat exchanger. When there are multiple tube sheets in a heat exchanger, the multiple tube sheets form a tube sheet assembly.

The outer perimeter 317 has disposed therein a number of semi-circular recess features 319 bounded by edge 381. The size of the recess features 319 is the same, defined by radius 325 taken from center point 323, which is located on an extended boundary defined by the outer perimeter 317. Each recess feature 319 extends a maximum distance 385 into the body 315 from the outer perimeter 317, where the distance 385 in this case equals the radius 325. Further, each recess feature 319 has a maximum width 327, in this case measured at the outer perimeter 317, which in this example equals twice the radius 325. The recess features 319 are positioned equidistantly along the outer perimeter 317, and each recess feature 319 is separated from each adjacent recess feature 319 by a distance 328.

Figure 4:
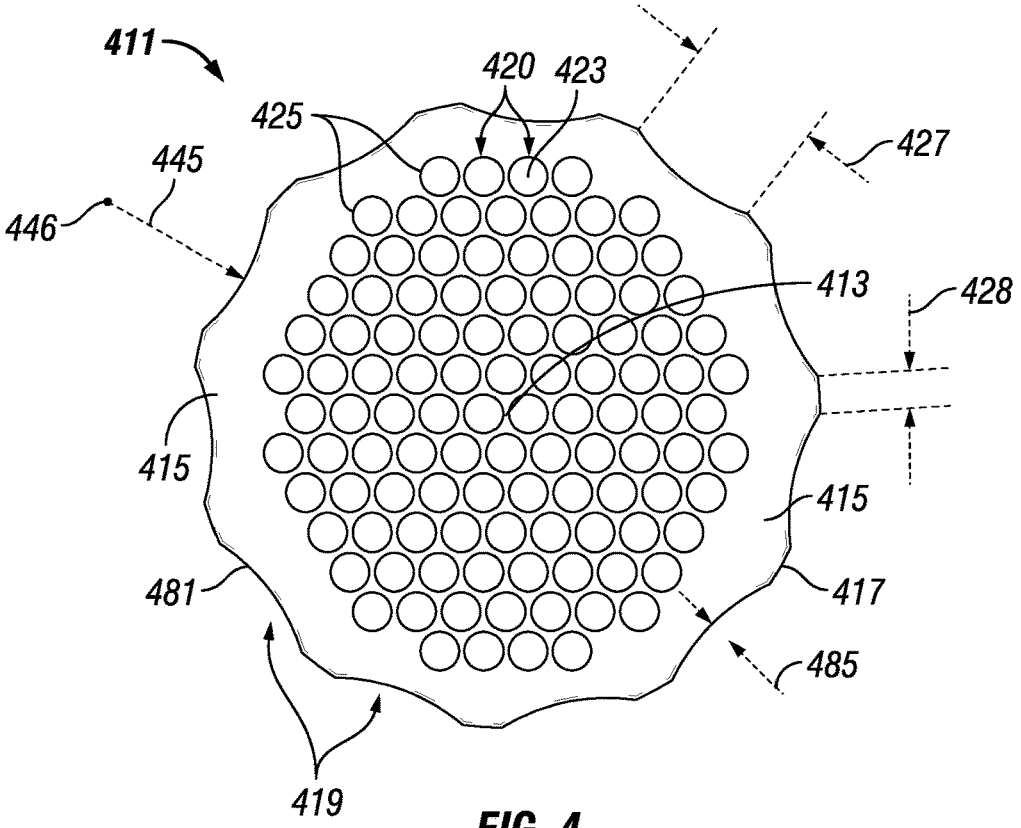
FIGS. 4-11 show various tube sheets in accordance with certain example embodiments.
Figure 5:
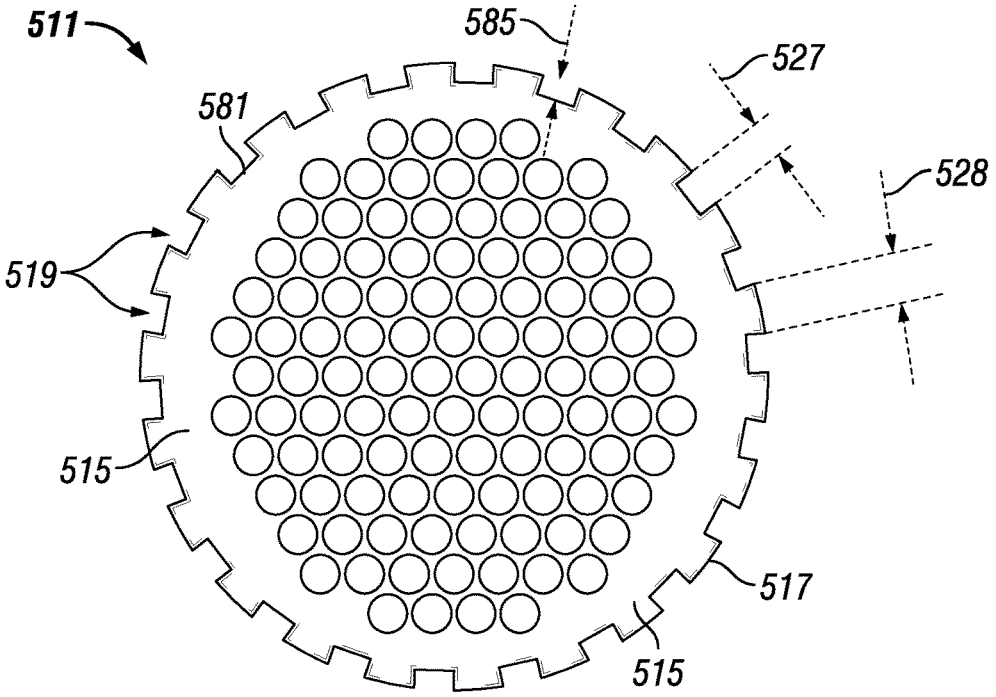
Figure 6:
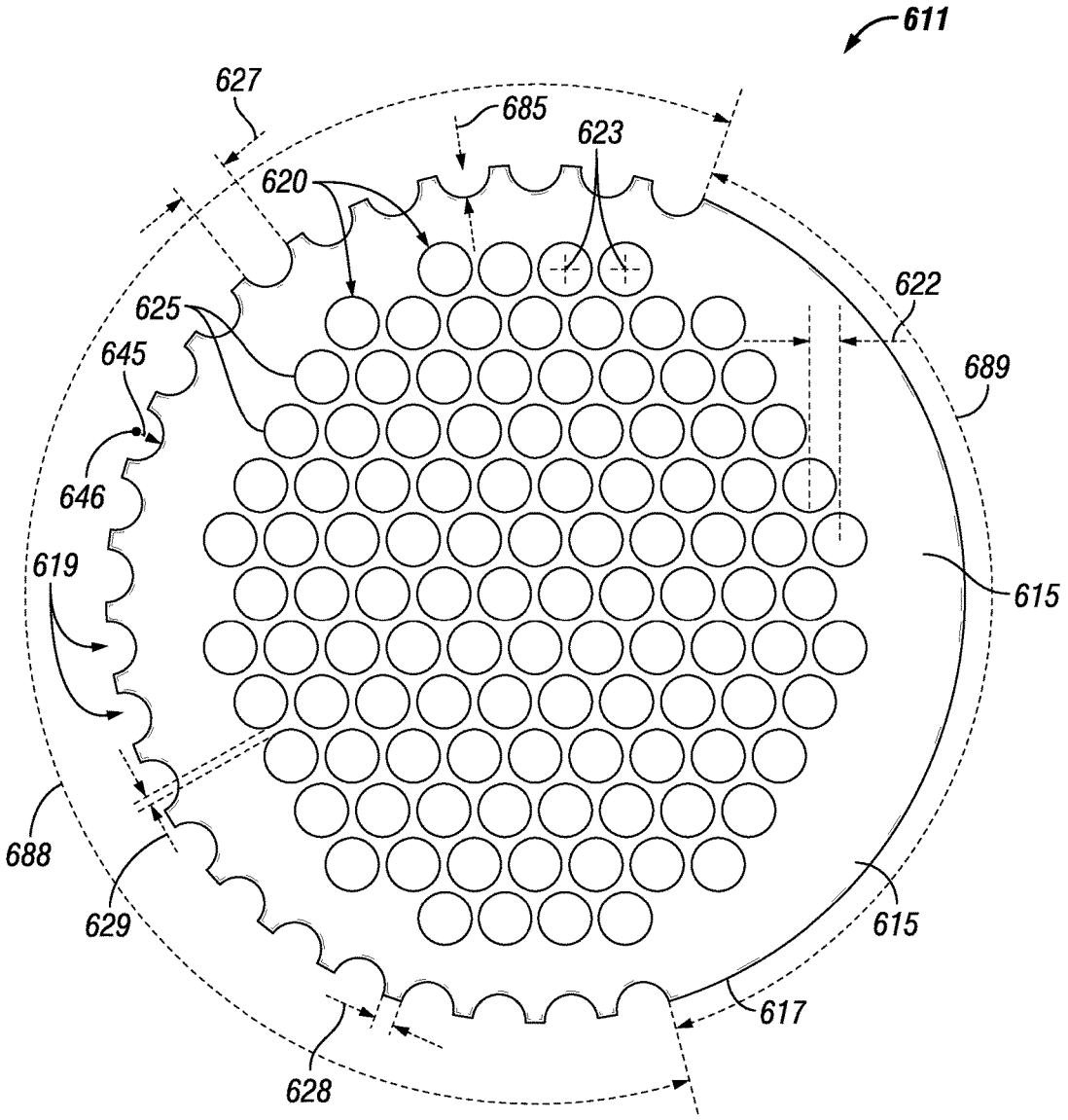
Figure 7:
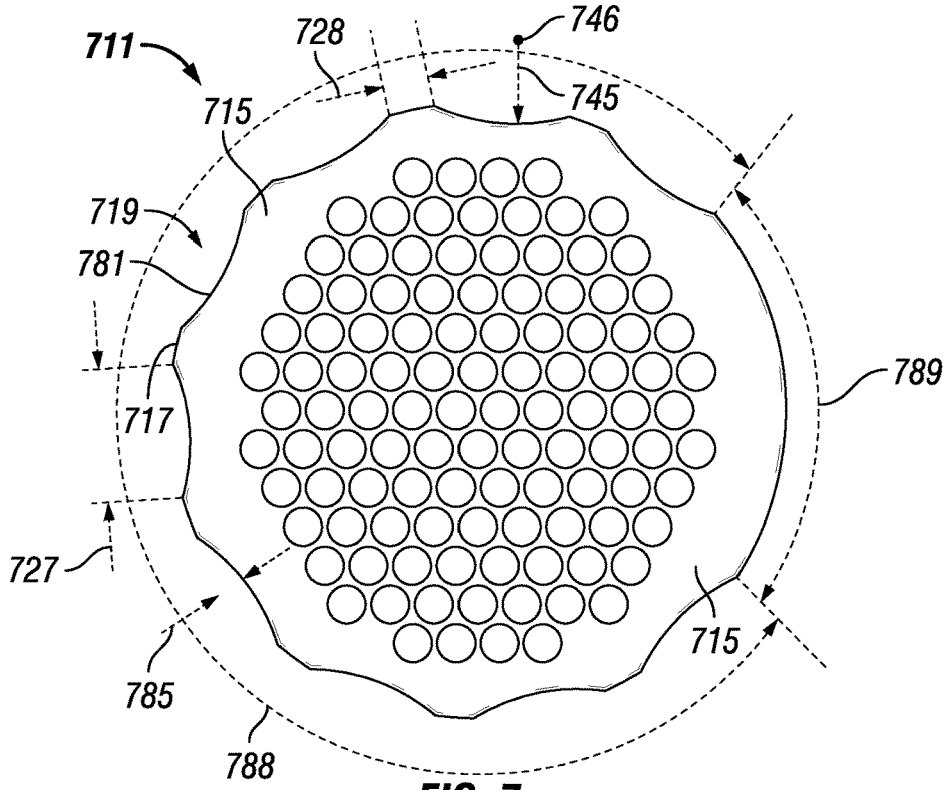
Figure 8:
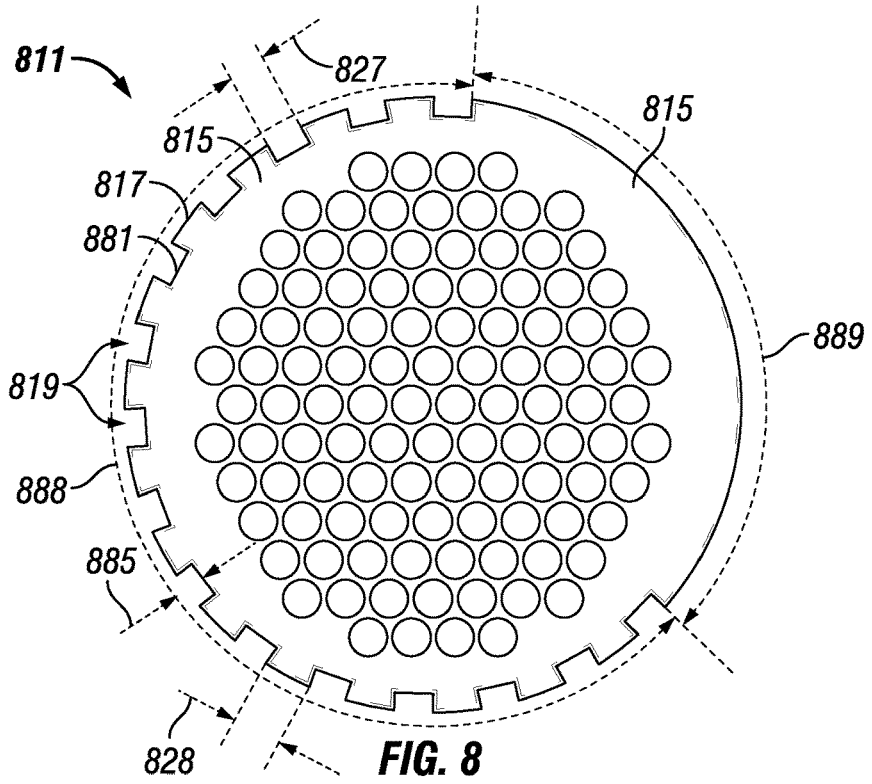
Figure 9:
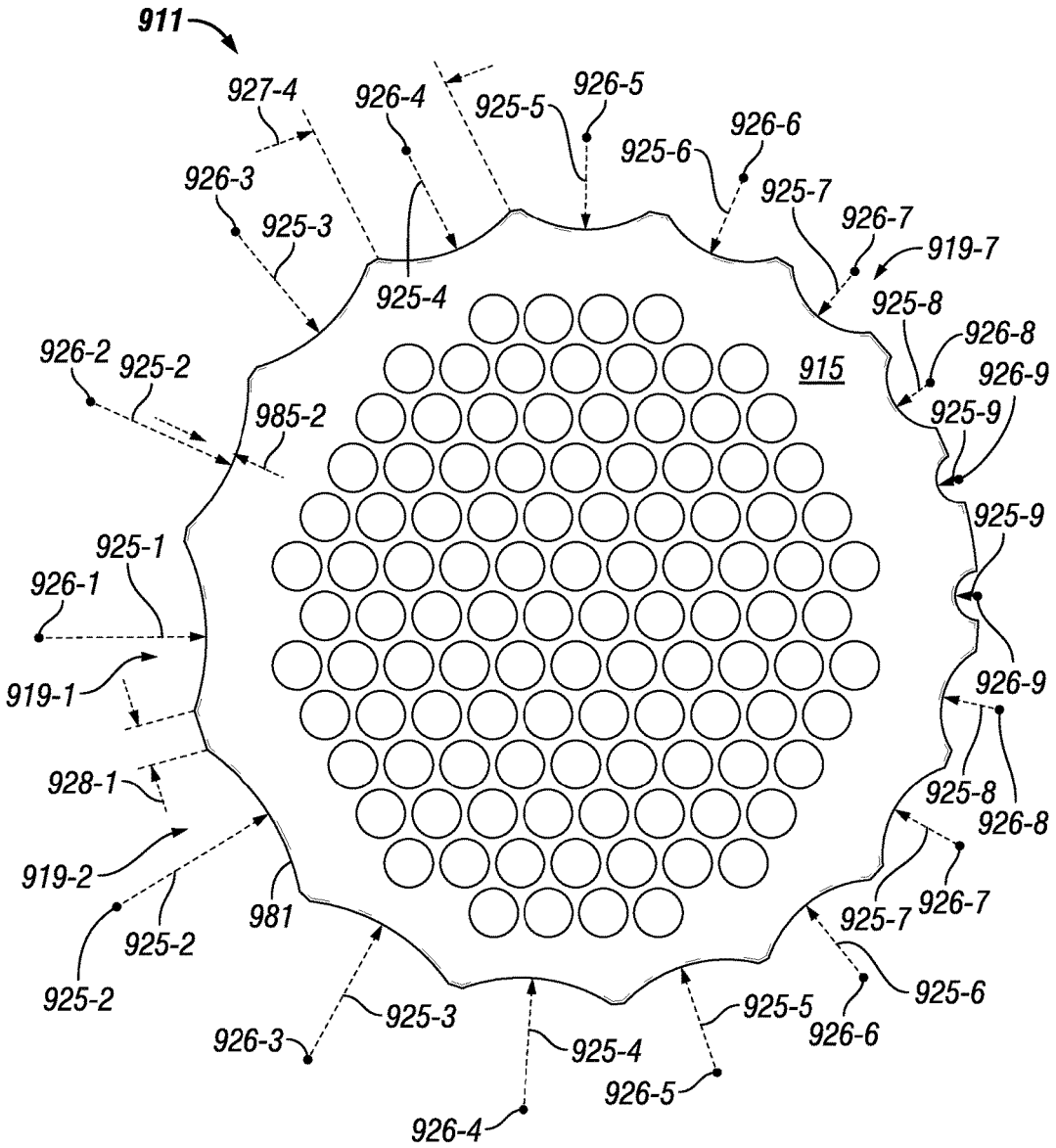
Figure 10:
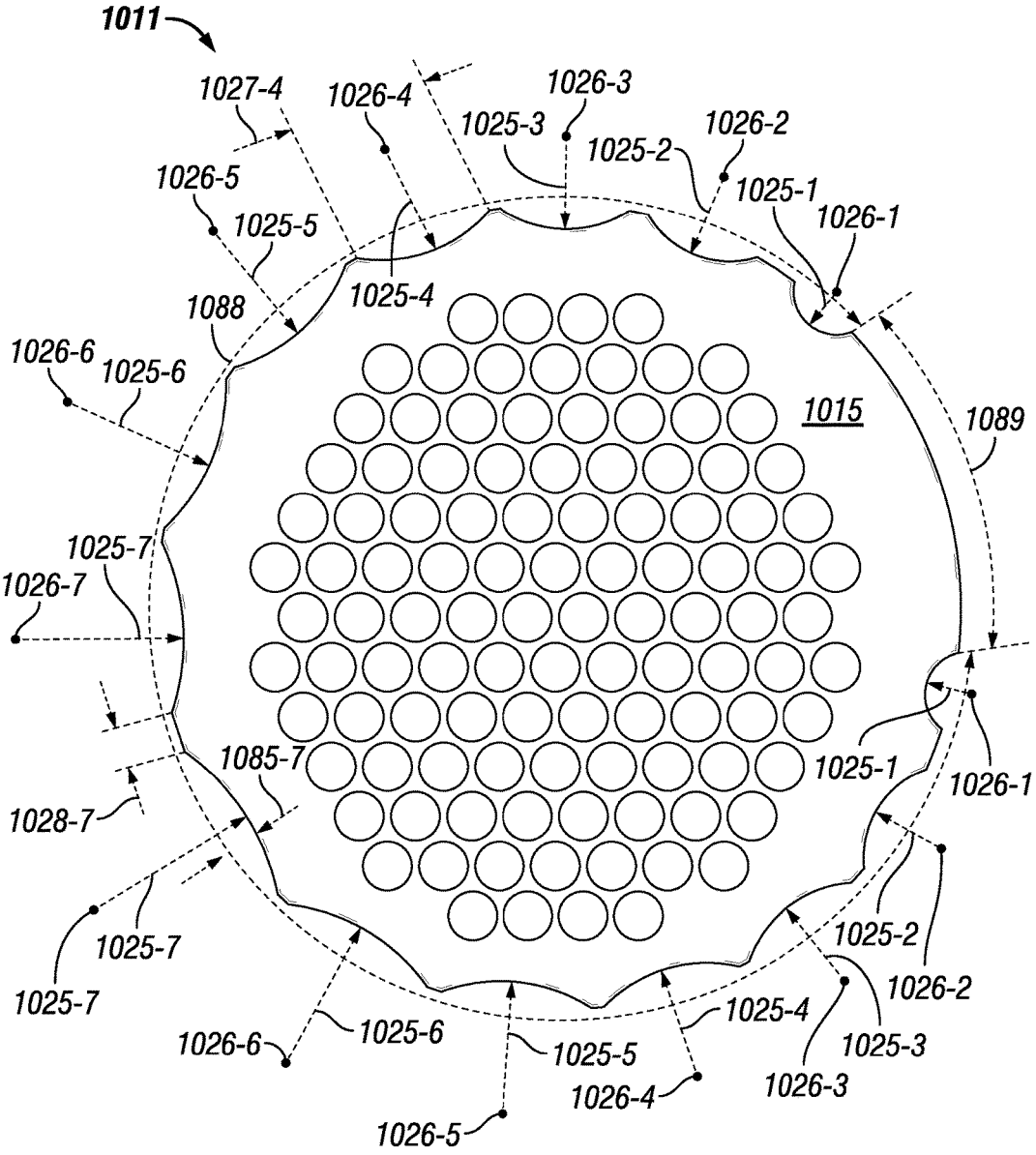
Figure 11:
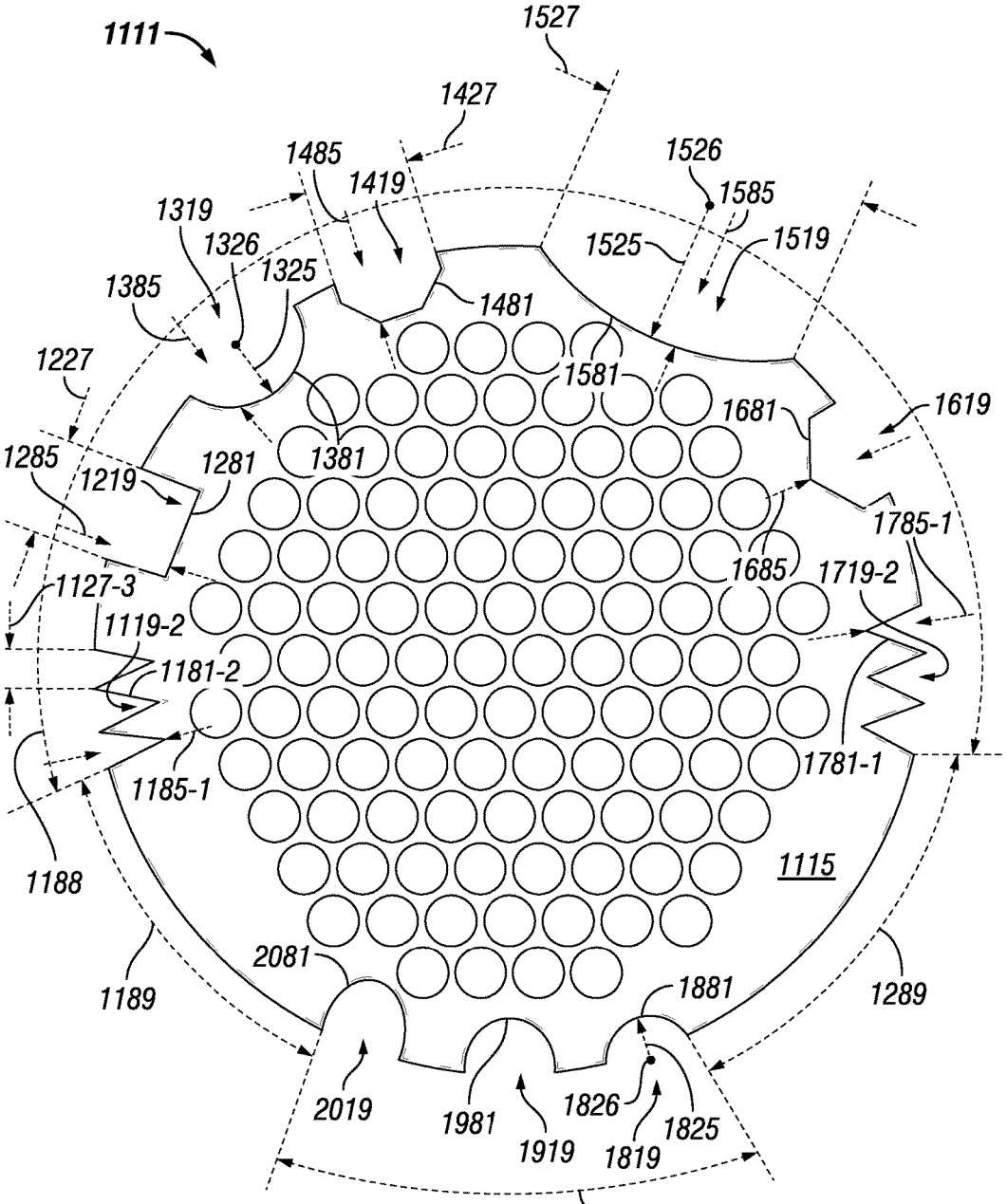

The recess features 319 are used to allow water to flow therethrough, where the water is used as part of the heat exchange process. Example embodiments are designed to more closely regulate and control the flow of water through the recess features of a tube sheet, thereby improving the efficiency of the heat exchanger and reducing costs and resources relative to embodiments currently known in the art. FIGS. 4-11 show a top view of various tube sheets in accordance with certain example embodiments. Specifically, FIG. 4 shows a top view of tube sheet 411. FIG. 5 shows a top view of tube sheet 511. FIG. 6 shows a top view of tube sheet 611. FIG. 7 shows a top view of tube sheet 711. FIG. 8 shows a top view of tube sheet 811. FIG. 9 shows a top view of tube sheet 911. FIG. 10 shows a top view of tube sheet 1011. FIG. 11 shows a top view of tube sheet 1111.

Referring to FIGS. 1A-11, while tube sheets (e.g., tube sheet 311) currently known in the art have semi-circular recess features (e.g., recess features 319) disposed around the outer perimeter 317 of the tube sheet, example tube sheets described herein have at least one recess feature that is not semi-circular and/or a portion of the outer perimeter of example tube sheets are featureless. For example, the example tube sheet 411 of FIG. 4 has an outer perimeter 417 with a number (in this case, 11) of identical recess features 419 bounded by edge 481 that are equally distributed around the entire outer perimeter 417.

Each recess feature 419 in this case is an arc defined by radius 425 taken from center point 423, which is located well beyond the extended boundary defined by the outer perimeter 417. Each recess feature 419 extends a maximum distance 485 into the body 415 from the outer perimeter 417, where the distance 485 is significantly less than the radius 425. Further, each recess feature 419 has a maximum width 427, in this case measured at the outer perimeter 417. The maximum width 427 can vary, based on the location of the center point 423 from which the radius 425 extends. As stated above, the recess features 419 are positioned equidistantly along the outer perimeter 417, and each recess feature 419 is separated from each adjacent recess feature 419 by a distance 428.

By having recess features 419 in the shape of wide arcs (as opposed to semi-circular shapes), the tube sheet 411 of FIG. 4 has fewer recess features 419 compared to the number of recess features 319 in the tube sheet 311 of FIG. 3. In this way, the water that flows through the recess features 419 in a heat exchanger having tube sheet 411 can be controlled in a way that differs from what the recess features 319 of the tube sheet 311 of FIG. 3 can provide.

As is true of all example embodiments contemplated herein, the shape formed by the outer perimeter 417 of the tube sheet 411 (as discussed above, in this case a circle) when viewed from above can vary depending on the shape of the cavity (e.g., cavity 155) formed by the wall (e.g., wall 151) of the heat exchanger (e.g., heat exchanger 100) inside of which the tube sheet 411 is disposed. Rather than a circle, the outer perimeter 417 of the tube sheet 411 can form any of a number of other shapes, including but not limited to a square, an oval, a triangle, an octagon, a random shape, and a hexagon.

The tube sheet 411 of FIG. 4 is otherwise substantially the same as the tube sheet 311 of FIG. 3. For example, there are a number of apertures 420 that traverse the body 415 of the tube sheet 411, where each aperture 420 has an outer perimeter 425 (which is part of the body 415) that forms, when viewed from above, a circle having a radius 422 and a center 423. The apertures 420 of the tube sheet 411 of FIG. 4 are arranged around center point 413 substantially similar to the arrangement of the apertures 320 that traverse the body 315 of the tube sheet 311 of FIG. 3.

The example tube sheet 511 of FIG. 5 has an outer perimeter 517 with a number (in this case, 22) of identical recess features 519 bounded by edge 581 that are equally distributed around the entire outer perimeter 517. Each recess feature 519 in this case is a rectangle defined by a height 585 (which is the same in this case as the maximum distance 485 that the recess feature 519 extends into the body 515 from the outer perimeter 517) and a width 527 (which in this case is substantially uniform along the height 585 of the recess feature 519). As stated above, the recess features 519 are positioned equidistantly along the outer perimeter 517, and each recess feature 519 is separated from each adjacent recess feature 519 by a distance 528.

The tube sheet 511 of FIG. 5 is otherwise substantially the same as the tube sheet 311 of FIG. 3 and the tube sheet 411 of FIG. 4. For example, there a number of apertures 520 that traverse the body 515 of the tube sheet 511, where each aperture 520 has an outer perimeter 525 (which is part of the body 515) that forms, when viewed from above, a circle having a radius 522 and a center 523. The apertures 520 of the tube sheet 511 of FIG. 5 are arranged around center point 513 substantially similar to the arrangement of the apertures 320 that traverse the body 315 of the tube sheet 311 of FIG. 3.

The example tube sheet 611 of FIG. 6 has an outer perimeter 617 with a number (in this case, 23) of identical recess features 619 bounded by edge 681 that are equally distributed around a portion 688 of the outer perimeter 617. Each recess feature 619 in this case is a semi-circle (as in FIG. 3) defined by a radius 625 taken from center point 623, which is located on an extended boundary defined by the outer perimeter 617. Each recess feature 619 extends a maximum distance 685 into the body 615 from the outer perimeter 617, where the distance 685 in this case equals the radius 625. Further, each recess feature 619 has a maximum width 627, in this case measured at the outer perimeter 617, which in this example equals twice the radius 625.

As stated above, the recess features 619 are positioned equidistantly along the portion 688 of the outer perimeter 617, and each recess feature 619 along the portion 688 is separated from each adjacent recess feature 619 by a distance 628. The remainder of the outer perimeter 617 (represented by portion 689) is featureless (i.e., has no recess features). In this way, the outer perimeter 617 of the example tube sheet 611 is asymmetrical with respect to the recess features 619.

The tube sheet 611 of FIG. 6 is otherwise substantially the same as the tube sheets of FIGS. 3-5 above. For example, there a number of apertures 620 that traverse the body 615 of the tube sheet 611, where each aperture 620 has an outer perimeter 625 (which is part of the body 615) that forms, when viewed from above, a circle having a radius 622 and a center 623. The apertures 620 of the tube sheet 611 of FIG. 6 are arranged around center point 613 substantially similar to the arrangement of the apertures 320 that traverse the body 315 of the tube sheet 311 of FIG. 3.

The example tube sheet 711 of FIG. 7 has an outer perimeter 717 with a number (in this case, 9) of identical recess features 719 bounded by edge 781 that are equally distributed around a portion 788 of the outer perimeter 717. Each recess feature 719 in this case is an arc (as in FIG. 4) defined by radius 725 taken from center point 726, which is located well beyond the extended boundary defined by the outer perimeter 717. Each recess feature 719 extends a maximum distance 785 into the body 715 from the outer perimeter 717, where the distance 785 is significantly less than the radius 725. Further, each recess feature 719 has a maximum width 727, in this case measured at the outer perimeter 717. The maximum width 727 can vary, based on the location of the center point 726 from which the radius 725 extends.

As stated above, the recess features 719 are positioned equidistantly along the portion 788 of the outer perimeter 717, and each recess feature 719 along the portion 788 is separated from each adjacent recess feature 719 by a distance 728. The remainder of the outer perimeter 717 (represented by portion 789) is featureless (i.e., has no recess features). In this way, the outer perimeter 717 of the example tube sheet 711 is asymmetrical with respect to the recess features 719.

The tube sheet 711 of FIG. 7 is otherwise substantially the same as the tube sheets of FIGS. 3-6 above. For example, there a number of apertures 720 that traverse the body 715 of the tube sheet 711, where each aperture 720 has an outer perimeter 725 (which is part of the body 715) that forms, when viewed from above, a circle having a radius 722 and a center 723. The apertures 720 of the tube sheet 711 of FIG. 7 are arranged around center point 713 substantially similar to the arrangement of the apertures 320 that traverse the body 315 of the tube sheet 311 of FIG. 3.

The example tube sheet 811 of FIG. 8 has an outer perimeter 817 with a number (in this case, 15) of identical recess features 819 bounded by edge 881 that are equally distributed around a portion 888 of the outer perimeter 817. Each recess feature 819 in this case is a rectangle defined by a height 885 (which is the same in this case as the maximum distance 885 that the recess feature 819 extends into the body 815 from the outer perimeter 817) and a width 827 (which is the same in this case is substantially uniform along the height 885 of the recess feature 819).

As stated above, the recess features 819 are positioned equidistantly along the portion 888 of the outer perimeter 817, and each recess feature 819 along the portion 888 is separated from each adjacent recess feature 819 by a distance 828. The remainder of the outer perimeter 817 (represented by portion 889) is featureless (i.e., has no recess features). In this way, the outer perimeter 817 of the example tube sheet 811 is asymmetrical with respect to the recess features 819.

The tube sheet 811 of FIG. 8 is otherwise substantially the same as the tube sheets of FIGS. 3-7 above. For example, there a number of apertures 820 that traverse the body 815 of the tube sheet 811, where each aperture 820 has an outer perimeter 825 (which is part of the body 815) that forms, when viewed from above, a circle having a radius 822 and a center 823. The apertures 820 of the tube sheet 811 of FIG. 8 are arranged around center point 813 substantially similar to the arrangement of the apertures 320 that traverse the body 315 of the tube sheet 311 of FIG. 3.

The example tube sheet 911 of FIG. 9 has an outer perimeter 917 with a number (in this case, 17) of recess features 919 bounded by edge 981 that are distributed around the entire outer perimeter 917. While each of the recess features 919 of FIG. 9 is an arc or semi-circle, many of these recess features 919 have a different size (e.g., radius) relative to each other. To simplify FIG. 9, reference numbers for a number of the features (e.g., recess feature 919, distance 985, width 927) are not expressly shown, even though they are described herein. Further, the numbering scheme of FIG. 9 has every reference number followed by "-X", where the X is associated with a particular recess feature 919. For example, width 927-3 refers to the maximum width of recess feature 919-3.

In this example, there is one recess feature 919-1, disposed along the left side of FIG. 9, that is an arc defined by radius 925-1 taken from center point 926-1, which is located well beyond the extended boundary defined by the outer perimeter 917. The recess feature 919-1 extends a maximum distance 985-1 into the body 915 from the outer perimeter 917, where the distance 985-1 is significantly less than the radius 925-1. Further, the recess feature 919-1 has a maximum width 927-1, in this case measured at the outer perimeter 917.

There are also two recess features 919-2, each adjacent to recess feature 919-1, that are each an arc defined by radius 925-2 (which is less than radius 925-1) taken from center point 926-2, which is located well beyond the extended boundary defined by the outer perimeter 917. Each of the recess features 919-2 extends a maximum distance 985-2 into the body 915 from the outer perimeter 917, where the distance 985-2 is significantly less than the radius 925-2. Further, the recess features 919-2 have a maximum width 927-2, in this case measured at the outer perimeter 917, where the width 927-2 is less than width 927-1.

Further, there are two recess features 919-3, each adjacent to recess features 919-2, that are each an arc defined by radius 925-3 (which is less than radius 925-2) taken from center point 926-3, which is located beyond the extended boundary defined by the outer perimeter 917. Each of the recess features 919-3 extends a maximum distance 985-3 into the body 915 from the outer perimeter 917, where the distance 985-3 is less than the radius 925-3. Further, the recess features 919-3 have a maximum width 927-3, in this case measured at the outer perimeter 917, where the width 927-3 is less than width 927-2.

In addition, there are two recess features 919-4, each adjacent to recess features 919-3, that are each an arc defined by radius 925-4 (which is less than radius 925-3) taken from center point 926-4, which is located beyond the extended boundary defined by the outer perimeter 917. Each of the recess features 919-4 extends a maximum distance 985-4 into the body 915 from the outer perimeter 917, where the distance 985-4 is less than the radius 925-4. Further, the recess features 919-4 have a maximum width 927-4, in this case measured at the outer perimeter 917, where the width 927-4 is less than width 927-3.

Further, there are two recess features 919-5, each adjacent to recess features 919-4, that are each an arc defined by radius 925-5 (which is less than radius 925-4) taken from center point 926-5, which is located beyond the extended boundary defined by the outer perimeter 917. Each of the recess features 919-5 extends a maximum distance 985-5 into the body 915 from the outer perimeter 917, where the distance 985-5 is less than the radius 925-5. Further, the recess features 919-5 have a maximum width 927-5, in this case measured at the outer perimeter 917, where the width 927-5 is less than width 927-4.

In addition, there are two recess features 919-6, each adjacent to recess features 919-5, that are each an arc defined by radius 925-6 (which is less than radius 925-5) taken from center point 926-6, which is located beyond the extended boundary defined by the outer perimeter 917. Each of the recess features 919-6 extends a maximum distance 985-6 into the body 915 from the outer perimeter 917, where the distance 985-6 is less than the radius 925-6. Further, the recess features 919-6 have a maximum width 927-6, in this case measured at the outer perimeter 917, where the width 927-6 is less than width 927-5.

Further, there are two recess features 919-7, each adjacent to recess features 919-6, that are each an arc defined by radius 925-7 (which is less than radius 925-6) taken from center point 926-7, which is located beyond the extended boundary defined by the outer perimeter 917. Each of the recess features 919-7 extends a maximum distance 985-7 into the body 915 from the outer perimeter 917, where the distance 985-7 is less than the radius 925-7. Further, the recess features 919-7 have a maximum width 927-7, in this case measured at the outer perimeter 917, where the width 927-7 is less than width 927-6.

In addition, there are two recess features 919-8, each adjacent to recess features 919-7, that are each an arc defined by radius 925-8 (which is less than radius 925-7) taken from center point 926-8, which is located beyond the extended boundary defined by the outer perimeter 917. Each of the recess features 919-8 extends a maximum distance 985-8 into the body 915 from the outer perimeter 917, where the distance 985-8 is less than the radius 925-8. Further, the recess features 919-8 have a maximum width 927-8, in this case measured at the outer perimeter 917, where the width 927-8 is less than width 927-7.

Finally, there are two recess features 919-9, each adjacent to recess features 919-8, that are each a semi-circle defined by radius 925-9 (which is less than radius 925-8) taken from center point 926-9, which is located along the extended boundary defined by the outer perimeter 917. Each of the recess features 919-9 extends a maximum distance 985-9 into the body 915 from the outer perimeter 917, where the distance 985-9 is equal to the radius 925-9. Further, the recess features 919-9 have a maximum width 927-9, in this case measured at the outer perimeter 917, where the width 927-9 is less than width 927-and is twice the radius 925-9.

While the various recess features 919 are positioned around the entire outer perimeter 917 of the tube sheet 911 of FIG. 9, the distance 928 between adjacent recess features can be the same as, or different than, the distance 928 between two or more other adjacent recess features 919. In this case, recess feature 919-1 is separated from each recess feature 919-2 by distance 928-1. Each recess feature 919-2 is separated from each recess feature 919-3 by distance 928-2. Each recess feature 919-3 is separated from each recess feature 919-4 by distance 928-3. Each recess feature 919-4 is separated from each recess feature 919-5 by distance 928-4. Each recess feature 919-5 is separated from each recess feature 919-6 by distance 928-5. Each recess feature 919-6 is separated from each recess feature 919-7 by distance 928-6. Each recess feature 919-7 is separated from each recess feature 919-8 by distance 928-7. Each recess feature 919-8 is separated from each recess feature 919-9 by distance 928-8.

The tube sheet 911 of FIG. 9 is otherwise substantially the same as the tube sheets of FIGS. 3-8 above. For example, there a number of apertures 920 that traverse the body 915 of the tube sheet 911, where each aperture 920 has an outer perimeter 925 (which is part of the body 915) that forms, when viewed from above, a circle having a radius 922 and a center 923. The apertures 920 of the tube sheet 911 of FIG. 9 are arranged around center point 913 substantially similar to the arrangement of the apertures 320 that traverse the body 315 of the tube sheet 311 of FIG. 3.

The example tube sheet 1011 of FIG. 10 has an outer perimeter 1017 with a number (in this case, 14) of recess features 1019 (similar to the recess features 919 of FIG. 9) bounded by edge 1081 that are distributed around a portion 1088 of the outer perimeter 1017. While each of the recess features 1019 of FIG. 10 is an arc or semi-circle, many of these recess features 1019 have a different size (e.g., radius) relative to each other. To simplify FIG. 10, reference numbers for a number of the features (e.g., recess feature 1019, distance 1085, width 1027) are not expressly shown, even though they are described herein. Further, the numbering scheme of FIG. 10 has every reference number followed by "-X", where the X is associated with a particular recess feature 1019. For example, width 1027-3 refers to the maximum width of recess feature 1019-3.

A portion 1089 of the outer perimeter 1017 is featureless, while portion 1088 of the outer perimeter includes the recess features 1019. Adjacent to either side of portion 1089 are recess features 1019-1, which are each a semi-circle defined by radius 1025-1 taken from center point 1026-1, which is located along the extended boundary defined by the outer perimeter 1017. Each of the recess features 1019-1 extends a maximum distance 1085-1 into the body 1015 from the outer perimeter 1017, where the distance 1085-1 is equal to the radius 1025-1. Further, the recess features 1019-1 have a maximum width 1027-1, in this case measured at the outer perimeter 1017, where the width 1027-1 is twice the radius 1025-1.

There are also two recess features 1019-2, each adjacent to recess feature 1019-1, that are each an arc defined by radius 1025-2 (which is greater than radius 1025-1) taken from center point 1026-2, which is located beyond the extended boundary defined by the outer perimeter 1017. Each of the recess features 1019-2 extends a maximum distance 1085-2 into the body 1015 from the outer perimeter 1017, where the distance 1085-2 is less than the radius 1025-2. Further, the recess features 1019-2 have a maximum width 1027-2, in this case measured at the outer perimeter 1017, where the width 1027-2 is greater than width 1027-1.

Further, there are two recess features 1019-3, each adjacent to recess features 1019-2, that are each an arc defined by radius 1025-3 (which is greater than radius 1025-2) taken from center point 1026-3, which is located beyond the extended boundary defined by the outer perimeter 1017. Each of the recess features 1019-3 extends a maximum distance 1085-3 into the body 1015 from the outer perimeter 1017, where the distance 1085-3 is less than the radius 1025-3. Further, the recess features 1019-3 have a maximum width 1027-3, in this case measured at the outer perimeter 1017, where the width 1027-3 is greater than width 1027-2.

In addition, there are two recess features 1019-4, each adjacent to recess features 1019-3, that are each an arc defined by radius 1025-4 (which is greater than radius 1025-3) taken from center point 1026-4, which is located beyond the extended boundary defined by the outer perimeter 1017. Each of the recess features 1019-4 extends a maximum distance 1085-4 into the body 1015 from the outer perimeter 1017, where the distance 1085-4 is less than the radius 1025-4. Further, the recess features 1019-4 have a maximum width 1027-4, in this case measured at the outer perimeter 1017, where the width 1027-4 is greater than width 1027-3.

Further, there are two recess features 1019-5, each adjacent to recess features 1019-4, that are each an arc defined by radius 1025-5 (which is greater than radius 1025-4) taken from center point 1026-5, which is located beyond the extended boundary defined by the outer perimeter 1017. Each of the recess features 1019-5 extends a maximum distance 1085-5 into the body 1015 from the outer perimeter 1017, where the distance 1085-5 is less than the radius 1025-5. Further, the recess features 1019-5 have a maximum width 1027-5, in this case measured at the outer perimeter 1017, where the width 1027-5 is greater than width 1027-4.

Further, there are two recess features 1019-6, each adjacent to recess features 1019-5, that are each an arc defined by radius 1025-6 (which is greater than radius 1025-5) taken from center point 1026-6, which is located beyond the extended boundary defined by the outer perimeter 1017. Each of the recess features 1019-6 extends a maximum distance 1085-6 into the body 1015 from the outer perimeter 1017, where the distance 1085-6 is less than the radius 1025-6. Further, the recess features 1019-6 have a maximum width 1027-6, in this case measured at the outer perimeter 1017, where the width 1027-6 is greater than width 1027-5.

Finally, there are two recess features 1019-7, each adjacent to recess features 1019-6, that are each an arc defined by radius 1025-7 (which is greater than radius 1025-6) taken from center point 1026-7, which is located beyond the extended boundary defined by the outer perimeter 1017. Each of the recess features 1019-7 extends a maximum distance 1085-7 into the body 1015 from the outer perimeter 1017, where the distance 1085-7 is less than the radius 1025-7. Further, the recess features 1019-7 have a maximum width 1027-7, in this case measured at the outer perimeter 1017, where the width 1027-7 is greater than width 1027-6. The two recess features 1019-7 are also adjacent to each other.

As stated above, the various recess features 1019 are positioned around portion 1088 of the outer perimeter 1017 of the tube sheet 1011 of FIG. 10, while portion 1089 of the outer perimeter 1017 is featureless. With respect to portion 1088, the distance 1028 between adjacent recess features can be the same as, or different than, the distance 1028 between two or more other adjacent recess features 1019. In this case, each recess feature 1019-1 is separated from each recess feature 1019-2 by distance 1028-1. Each recess feature 1019-2 is separated from each recess feature 1019-3 by distance 1028-2. Each recess feature 1019-3 is separated from each recess feature 1019-4 by distance 1028-3. Each recess feature 1019-4 is separated from each recess feature 1019-5 by distance 1028-4. Each recess feature 1019-5 is separated from each recess feature 1019-6 by distance 1028-5. Each recess feature 1019-6 is separated from each recess feature 1019-7 by distance 1028-6. Adjacent recess features 1019-7 are separated from each other by distance 1028-7.

The tube sheet 1011 of FIG. 10 is otherwise substantially the same as the tube sheets of FIGS. 3-9 above. For example, there a number of apertures 1020 that traverse the body 1015 of the tube sheet 1011, where each aperture 1020 has an outer perimeter 1025 (which is part of the body 1015) that forms, when viewed from above, a circle having a radius 1022 and a center 1023. The apertures 1020 of the tube sheet 1011 of FIG. 10 are arranged around center point 1013 substantially similar to the arrangement of the apertures 320 that traverse the body 315 of the tube sheet 311 of FIG. 3.

The example tube sheet 1111 of FIG. 11 has an outer perimeter 1117 with a number (in this case, 14) of recess features 1119 that are distributed around a portion 1188 and a portion 1288 of the outer perimeter 1117. Many of the recess features 1119 of FIG. 11 have a different shape and size relative to each other. To simplify FIG. 11, reference numbers for a number of the features (e.g., recess feature 1119, distance 1185, width 1127) are not expressly shown, even though they are described herein.

A portion 1189 of the outer perimeter 1117 is featureless, and another portion 1289 of the outer perimeter 1117 is also featureless. Disposed between portion 1189 and portion 1289 are portion 1188 and portion 1288 of the outer perimeter 1117, where portion 1188 has 11 recess features, and where portion 1288 has three recess features. The three recess features of portion 1288 include recess feature 1819 bounded by edge 1881, recess feature 1919 bounded by edge 1981, and recess feature 2019 bounded by edge 2081.

Recess feature 1819, located between recess feature 1919 and featureless portion 1289 of the outer perimeter 1117, is a semi-circle defined by radius 1825 taken from center point 1826, which is located along the extended boundary defined by the outer perimeter 1117. The recess feature 1819 extends a maximum distance 1885 into the body 1115 from the outer perimeter 1117, where the distance 1885 is equal to the radius 1825. Further, the recess feature 1819 has a maximum width 1827, in this case measured at the outer perimeter 1117, where the width 1827 is twice the radius 1825.

Recess feature 1919, located between recess feature 1819 and recess feature 2019, is a parabolic shape defined by a focus point 1926, which is located beyond the extended boundary defined by the outer perimeter 1117. The recess feature 1919 extends a maximum distance 1985 into the body 1115 from the outer perimeter 1117, where the distance 1985 is greater than the distance 1885. Further, the recess feature 1919 has a maximum width 1927, in this case measured at the outer perimeter 1117.

Recess feature 2019, located between recess feature 1919 and featureless portion 1189 of the outer perimeter 1117, is most of an elongated oval. The recess feature 2019 extends a maximum distance 2085 into the body 1115 from the outer perimeter 1117, where the distance 2085 is greater than the distance 1885 and the distance 1985. Further, the recess feature 1819 has a maximum width 1827, in this case measured within the body 1115.

The eleven recess features of portion 1188 include recess feature 1119-1 bounded by edge 1181-1, recess feature 1119-2 bounded by edge 1181-2, recess feature 1119-3 bounded by edge 1181-3, recess feature 1219 bounded by edge 1281, recess feature 1319 bounded by edge 1381, recess feature 1419 bounded by edge 1481, recess feature 1519 bounded by edge 1581, recess feature 1619 bounded by edge 1681, recess feature 1719-1 bounded by edge 1781-1, recess feature 1719-2 bounded by edge 1781-2, and recess feature 1719-3 bounded by edge 1781-3.

Recess feature 1119-1 is located between portion 1189 and recess feature 1119-2, which is located next to recess feature 1119-3, which is located next to recess feature 1219. Recess feature 1119-1, recess feature 1119-2, and recess feature 1119-3 form a sawtooth shape and are identical to each other. Recess feature 1119-1, recess feature 1119-2, and recess feature 1119-3 each extend a maximum distance 1185-1, maximum distance 1185-2, and maximum distance 1185-3, respectively, into the body 1115 from the outer perimeter 1117. Further, recess feature 1119-1, recess feature 1119-2, and recess feature 1119-3 each has a maximum width 1127-1, width 1127-2, and width 1127-3, respectively, measured at the outer perimeter 1117.

Recess feature 1219 is disposed between recess feature 1119-3 and recess feature 1319. Recess feature 1219 is a rectangle defined by a height 1185 (which is the same in this case as the maximum distance 1185 that the recess feature 1119 extends into the body 1115 from the outer perimeter 1117) and a width 1127 (which is the same in this case is substantially uniform along the height 1185 of the recess feature 1119.

Recess feature 1319 is disposed between recess feature 1419 and recess feature 1319. Recess feature 1319 is a semi-circle defined by radius 1325 taken from center point 1326, which is located along the extended boundary defined by the outer perimeter 1117. The recess feature 1319 extends a maximum distance 1385 into the body 1115 from the outer perimeter 1117, where the distance 1385 is equal to the radius 1325. Further, the recess feature 1319 has a maximum width 1327, in this case measured at the outer perimeter 1117, where the width 1327 is twice the radius 1325.

Recess feature 1419 is disposed between recess feature 1419 and recess feature 1519. Recess feature 1419 is substantially one half of an octagon defined by five linear segments. Recess feature 1419 has a maximum distance 1485 that the recess feature 1419 extends into the body 1115 from the outer perimeter 1117. Recess feature 1419 also has a width 1427, which in this case is measured at the outer perimeter 1117.

Recess feature 1519 is disposed between recess feature 1419 and recess feature 1619. Recess feature 1519 is an arc (as in FIGS. 4 and 7) defined by radius 1425 taken from center point 1426, which is located well beyond the extended boundary defined by the outer perimeter 1117. The recess feature 1419 extends a maximum distance 1485 into the body 1115 from the outer perimeter 1117, where the distance 1485 is significantly less than the radius 1425. Further, the recess feature 1419 has a maximum width 1427, in this case measured at the outer perimeter 1117.

Recess feature 1619 is disposed between recess feature 1519 and recess feature 1719. Recess feature 1619 is substantially one half of a hexagon defined by four linear segments. Recess feature 1619 has a maximum distance 1685 that the recess feature 1619 extends into the body 1115 from the outer perimeter 1117. Recess feature 1619 also has a width 1627, which in this case is measured at the outer perimeter 1117.

Recess feature 1719-1 is located between recess feature 1619 and recess feature 1719-2, which is located next to recess feature 1719-3, which is located next to portion 1289. Recess feature 1719-1, recess feature 1719-2, and recess feature 1719-3 form a sawtooth shape and are identical to each other. Recess feature 1719-1, recess feature 1719-2, and recess feature 1719-3 each extend a maximum distance 1785-1, maximum distance 1785-2, and maximum distance 1785-3, respectively, into the body 1115 from the outer perimeter 1117. Further, recess feature 1719-1, recess feature 1719-2, and recess feature 1719-3 each has a maximum width 1727-1, width 1727-2, and width 1727-3, respectively, measured at the outer perimeter 1117.

The tube sheet 1111 of FIG. 11 is otherwise substantially the same as the tube sheets of FIGS. 3-10 above. For example, there a number of apertures 1120 that traverse the body 1115 of the tube sheet 1111, where each aperture 1120 has an outer perimeter 1125 (which is part of the body 1115) that forms, when viewed from above, a circle having a radius 1122 and a center 1123. The apertures 1120 of the tube sheet 1111 of FIG. 11 are arranged around center point 1113 substantially similar to the arrangement of the apertures 320 that traverse the body 315 of the tube sheet 311 of FIG. 3.

As discussed above with respect to FIG. 2, a heat exchanger can include multiple tube sheets, called a tube sheet assembly herein. In such a case, at least one of the tube sheets in a tube sheet assembly can be an example tube sheet described herein. Further, one of the tube sheets of the tube sheet assembly can be the same as, or different than, one or more of the other tube sheets in the tube sheet assembly. If one of the tube sheets in a tube sheet assembly is different than an example tube sheet in the tube sheet assembly, the different tube sheet can be a tube sheet currently known in the art (as shown in FIG. 3) or an example tube sheet with a different configuration of recess features.

Example embodiments described herein allow for flexible and more efficient designs for heat exchangers in which example tube sheets can be used. Example embodiments can be used to improve the flow of fluid through heat exchangers, where such fluids absorb thermal energy (e.g., heat, cold) for use in another process. Example embodiments can also be used to help ensure that water used in this heat exchange process flows in a more specific and efficient manner. Example embodiments can be customizable with respect to any of a number of characteristics (e.g., shape, size, cavity). Further, the shape, size, and dimensions of an example tube sheet can be specifically configured for a particular heat exchanger. Example embodiments can be mass produced or made as a custom order. Example tube sheet assemblies can include two or more tube sheets where at least one of the tube sheets has at least one recess feature disposed along its outer perimeter that is not semi-circular. In a tube sheet assembly, one tube sheet can be configured the same as, or different than, the other tube sheets.

Example tube sheets help improve the development of a heat exchanger (e.g., a condensing boiler, a combustion chamber, a water heater). Heat exchanger design and its relationship with the combustion chamber is critical in fire-tube equipment designs. In a number of heat exchanger designs, heated water from the heat exchanger passes through a tube sheet and around the combustion chamber before exiting the heat exchanger. The performance, dimensions, and efficiency of such a heat exchanger depends on the effectiveness of the flow around the combustion chamber. Water side flow management is one of the essential aspects of the design improvement of a heat exchanger, and example tube sheets are designed to better manage the flow of the heat water within a heat exchanger relative to tube sheets currently used in the art.

The water side fluid flow uniformity is critical for effective heat transfer between water flow and the outer combustion chamber wall. However, the uniformity of water side fluid flow around combustion chamber gap is not attainable easily and needs specific geometrical designs for at least the top tube sheet. The non-uniformity of the fluid flow around the combustion chamber, recirculation flow regions, and the unreasonably high fluid velocity in some specific regions near the water outlet flange of a heat exchanger using currently known tube sheets have led to problems with efficiency and component failure.

Example tube sheets and tube sheet assemblies can regulate (e.g., decrease velocity, increase velocity) the flow of heated water in a heat exchanger around the combustion chamber. Example tube sheets and tube sheet assemblies can also improve thermal efficiency of the heated water relative to currently known tube sheets. For example, tube sheets described herein can reduce the peak temperature (e.g., by 110° F.) of the heated water that flows around the combustion chamber.

The various configurations, including the size, number, symmetric/asymmetric design, and shape of the recess features of example tube sheets described herein can help make the flow pattern of the fluid (e.g., heated water) in a heat exchanger designed for a specific flow pattern and/or flow rate. Example embodiments can also be used in environments that require compliance with one or more standards and/or regulations.

Accordingly, many modifications and other embodiments set forth herein will come to mind to one skilled in the art to which example tube sheets and tube sheet assemblies pertain having the benefit of the teachings presented in the foregoing descriptions and the associated drawings. Therefore, it is to be understood that example tube sheets and tube sheet assemblies are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A planar tube sheet for a thermal transfer device, wherein the planar tube sheet comprises:

a body having a uniform thickness and a plurality of apertures that traverse therethrough, wherein each of the plurality of apertures has a length that equals the thickness of the body and is configured to receive a plurality of tubes of the thermal transfer device; and an outer perimeter defining the body, wherein the outer perimeter has three or more first recess features disposed therein, wherein the three or more recess features have a first shape and a first size, wherein the first shape is any shape aside from a semi-circle, wherein the body and the outer perimeter are planar with respect to each other, wherein the outer perimeter, not considering the three or more first recess features, has a circular shape, and wherein the three or more first recess features are substantially equally distributed around the outer perimeter.

2. The planar tube sheet of claim 1, wherein the first shape is a non-semi-circular arc having a radius.

3. The planar tube sheet of claim 1, wherein the outer perimeter further comprises at least one second recess feature therein, wherein the at least one second recess feature is disposed between two of the three or more first recess features.

4. The planar tube sheet of claim 3, wherein the at least one second recess feature is defined by a first arc having a first radius.

5. The planar tube sheet of claim 3, wherein the outer perimeter further has at least one third recess feature having a second shape.

6. The planar tube sheet of claim 5, wherein the second shape is defined by at least one straight edge.

7. The planar tube sheet of claim 3, wherein there are a plurality of the at least one second recess feature, wherein the three or more first recess features and the plurality of second recess features are alternately disposed around the outer perimeter.

8. A tube sheet assembly for a thermal transfer device, wherein the tube sheet assembly comprises:

a first tube sheet including:

a first body having a uniform first thickness and a plurality of first apertures that traverse therethrough, wherein each of the plurality of first apertures has a first length that equals the first thickness of the first body and is configured to receive a first end of a plurality of tubes of the thermal transfer device; and a first outer perimeter defining the first body, wherein the first outer perimeter has three or more first recess features disposed therein, wherein the three or more first recess features have a first shape and a first size, wherein the first shape is any shape aside from a semi-circle, wherein the first body and the first outer perimeter are planar with respect to each other, wherein the first outer perimeter, not considering the three or more first recess features, has a circular shape, and wherein the three or more first recess features are substantially equally distributed around the first outer perimeter; and a second tube sheet including:

a second body having a plurality of second apertures that traverse therethrough, wherein the plurality of second apertures are configured to receive a second end of the plurality of tubes of the thermal transfer device; and a second outer perimeter defining the second body; and the plurality of tubes connecting the first tube sheet and the second tube sheet.

9. A thermal transfer device comprising:

at least one wall that forms a cavity;

a plurality of tubes disposed within the cavity, wherein each of the plurality of tubes has a first end and a second end;

a first tube sheet disposed within the cavity, wherein the first tube sheet comprises:

a first body having a uniform first thickness and a plurality of first apertures that traverse therethrough, wherein each of the plurality of first apertures has a first length that equals the first thickness of the first body and receives the first end of the plurality of tubes; and a first outer perimeter defining the first body, wherein the first outer perimeter has three or more first recess features disposed therein, wherein the three or more first recess features have a first shape and a first size, wherein the first shape is any shape aside from a semi-circle, wherein the first body and the first outer perimeter are planar with respect to each other, wherein the first outer perimeter, not considering the three or more first recess features, has a circular shape, and wherein the three or more first recess features are substantially equally distributed around the first outer perimeter; and a second tube sheet disposed within the cavity, wherein the second tube sheet comprises:

a second body having a plurality of second apertures that traverse therethrough, wherein the plurality of second apertures receive the second end of the plurality of tubes; and a second outer perimeter defining the second body.

* * * * *